US008485407B2

(12) United States Patent
Liu et al.

(10) Patent No.: US 8,485,407 B2
(45) Date of Patent: Jul. 16, 2013

(54) FASTENER FEEDING DEVICE FOR A DRIVING TOOL

(75) Inventors: Angi Liu, Taichung (TW); Yuan-Chi Chiang, Taichung (TW); Fu-Ying Huang, Taichung (TW)

(73) Assignee: Basso Industry Corp., Taichung (TW)

( * ) Notice: Subject to any disclaimer, the term of this patent is extended or adjusted under 35 U.S.C. 154(b) by 206 days.

(21) Appl. No.: 13/169,916

(22) Filed: Jun. 27, 2011

(65) Prior Publication Data

US 2011/0315738 A1 Dec. 29, 2011

(30) Foreign Application Priority Data

Jun. 28, 2010 (TW) ..... 99121037 A

(51) Int. Cl.
*B27F 7/00* (2006.01)
*B25C 1/04* (2006.01)

(52) U.S. Cl.
USPC ..... 227/8; 227/119; 227/130; 227/138

(58) Field of Classification Search
USPC ..... 227/8, 10, 120, 109, 136, 138, 130, 227/112, 119
See application file for complete search history.

(56) References Cited

U.S. PATENT DOCUMENTS

| | | | | |
|---|---|---|---|---|
| 5,558,264 | A * | 9/1996 | Weinstein | 227/10 |
| 6,994,240 | B2 * | 2/2006 | Jakob et al. | 227/8 |
| 7,137,186 | B2 * | 11/2006 | Wojcicki et al. | 29/592 |
| 7,225,962 | B2 * | 6/2007 | Porth et al. | 227/136 |
| 7,455,207 | B2 * | 11/2008 | Wojcicki et al. | 227/120 |
| 7,556,182 | B2 | 7/2009 | Murayama et al. | |
| 7,703,648 | B2 * | 4/2010 | Tamura et al. | 227/8 |
| 7,938,303 | B2 * | 5/2011 | Tamura et al. | 227/10 |
| 2008/0314953 | A1 | 12/2008 | Moeller et al. | |

* cited by examiner

*Primary Examiner* — Scott A. Smith
(74) *Attorney, Agent, or Firm* — Holland & Hart LLP

(57) ABSTRACT

A fastener feeding device for repeatedly feeding fasteners into a striking path of a driving tool includes an uplifting unit having a pivotable member which is pivotable about a torsion axis parallel to the striking path and movable in a feeding direction, a claw member which is biased by a torsion spring to hold a second fastener during an upward movement of the fasteners when the pivotable member is displaced from a lower position to an upper position, and a lifting member which extends transversely. A force transmitting unit is disposed to couple a contact arm of the driving tool to the lifting member to effect the upward movement of the fasteners in response to a rearward displacement of the contact arm when the contact arm is pressed by a targeted object to be fastened.

10 Claims, 10 Drawing Sheets

FASTENER FEEDING DEVICE FOR A DRIVING TOOL

CROSS-REFERENCE TO RELATED APPLICATION

This application claims priority of Taiwanese Patent Application No. 099121037, filed on Jun. 28, 2010, the disclosure of which is herein incorporated by reference.

BACKGROUND OF THE INVENTION

1. Field of the Invention

This invention relates to a gas combustion type driving tool, more particularly to a fastener feeding device for a gas combustion type driving tool.

2. Description of the Related Art

Referring to FIGS. 1 and 2, a gas combustion type driving tool 1 disclosed in U.S. Pat. No. 7,556,182 B2 is shown to include a striking piston 181 driven by a combustion gas to move within a striking cylinder 11 of a tool body 12 so as to move a driver 182 out of a nose part 121 for driving a fastener 2 into a targeted object (A). A fastener feeding device 19 includes a feed cylinder 191 and a feed piston 192 urged by a spring 193 to move in a feeding direction within the feed cylinder 191. The feed cylinder 191 is in fluid communication with a combustion chamber 10 through a gas conduit 15, and a delay piston/cylinder device 16 is disposed in the gas conduit 15. A first check valve 151 and a second check valve 152 are disposed downwardly of the delay piston/cylinder device 16, and a switch valve 17 is disposed between the second check valve 152 and the feed cylinder 191. In a nail driving operation, when the nose part 121 is pressed against the targeted object (A) to move a contact arm 14 upward, the combustion gas is injected into the combustion chamber 10 and is mixed with air. Once a trigger 13 is pulled, the mixed gas is ignited, burned, and expanded explosively. The pressure of the combustion gas acts onto the striking piston 181 to drive the nail 2. Meanwhile, the pressure of the combustion gas also acts onto the delay piston/cylinder device 16, and the air which is introduced therein from the atmosphere through the first check valve 151 is compressed. Consequently, the compressed air is admitted into the feed cylinder 191 through the second check valve 152 so as to rise up to sufficiently move the feed piston 192 against the spring 193, thereby performing a fastener feeding operation. Thus, the supply of the pressure of the combustion gas from the combustion chamber 10 to the feed cylinder 191 can delay the fastener feeding operation.

However, since the carbon content of the combustion gas is quite high, carbon may accumulate in the conduit 15 to adversely affect the fastener feeding operation.

Another fastener driving tool as disclosed in U.S. Publication No. 20080314953 is provided with an electromechanical retention device that is operationally associated with a fastener feeding mechanism for causing a difference in the operation timing between a striking process and a fastener feeding process. However, the provision of the electromechanical retention device renders the structure of the fastener driving tool quite complicated.

SUMMARY OF THE INVENTION

An object of the present invention is to provide a fastener feeding device for a driving tool which has a simple construction, and which can feed fasteners smoothly and successfully without the need to be provided with a combustion gas-operated or electromechanical mechanism.

According to this invention, the fastener feeding device includes a mounting seat adapted to be mounted to a tool body and under a striking path of a leading fastener. An uplifting unit includes a pivotable member which is configured to be pivotable about a torsion axis, and movable relative to the mounting seat between upper and lower positions, a torsion spring disposed to couple with the pivotable member to exert an angularly biasing force, a claw member configured to holdingly engage a second fastener during an upward movement of the fasteners from a pre-feed position that corresponds to the lower position to a fed position, where the leading fastener is in line with the path line of the striking path, when the pivotable member is displaced to the upper position, and a lifting member having a lifting end which is coupled with the claw member to effect the upward movement of the fasteners, and an actuated end. A force transmitting unit is configured to couple the contact arm to the actuated end of the lifting member to actuate the lifting end to effect the upward movement of the fasteners in response to a rearward displacement of a contact arm when the contact arm is pressed by a targeted object to be fastened. A return biasing member is disposed to bias the pivotable member toward the lower position. As a result of the downward movement of the pivotable member, the claw member is dragged downward against the angularly biasing force of the torsion spring to engage a third fastener which had taken the place of the second fastener at the pre-fed position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
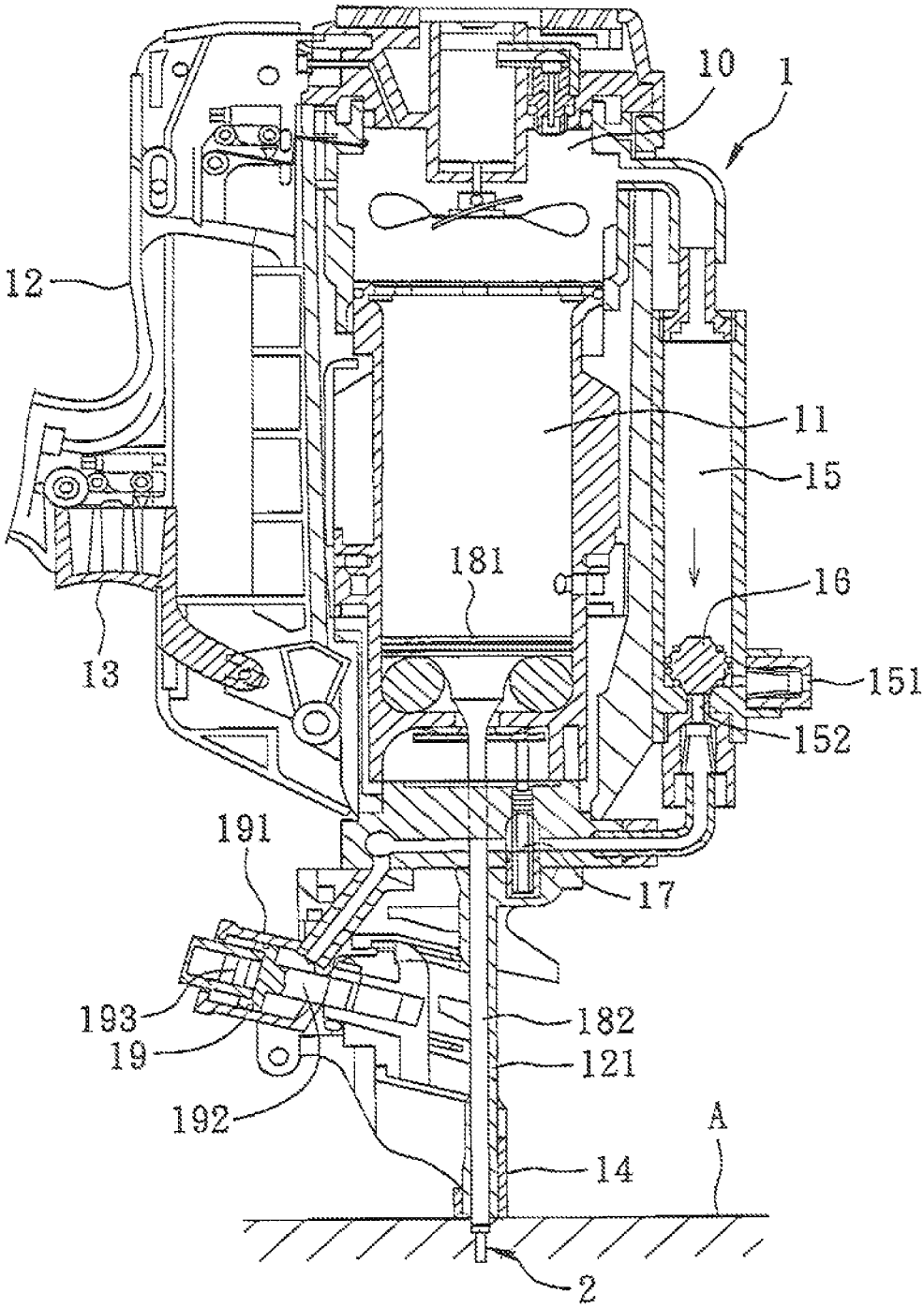
FIG. 1 PRIOR ART
FIG. 1 is a sectional view of a conventional fastener driving tool, showing a delay piston/cylinder device in a retreat state.
Figure 2:
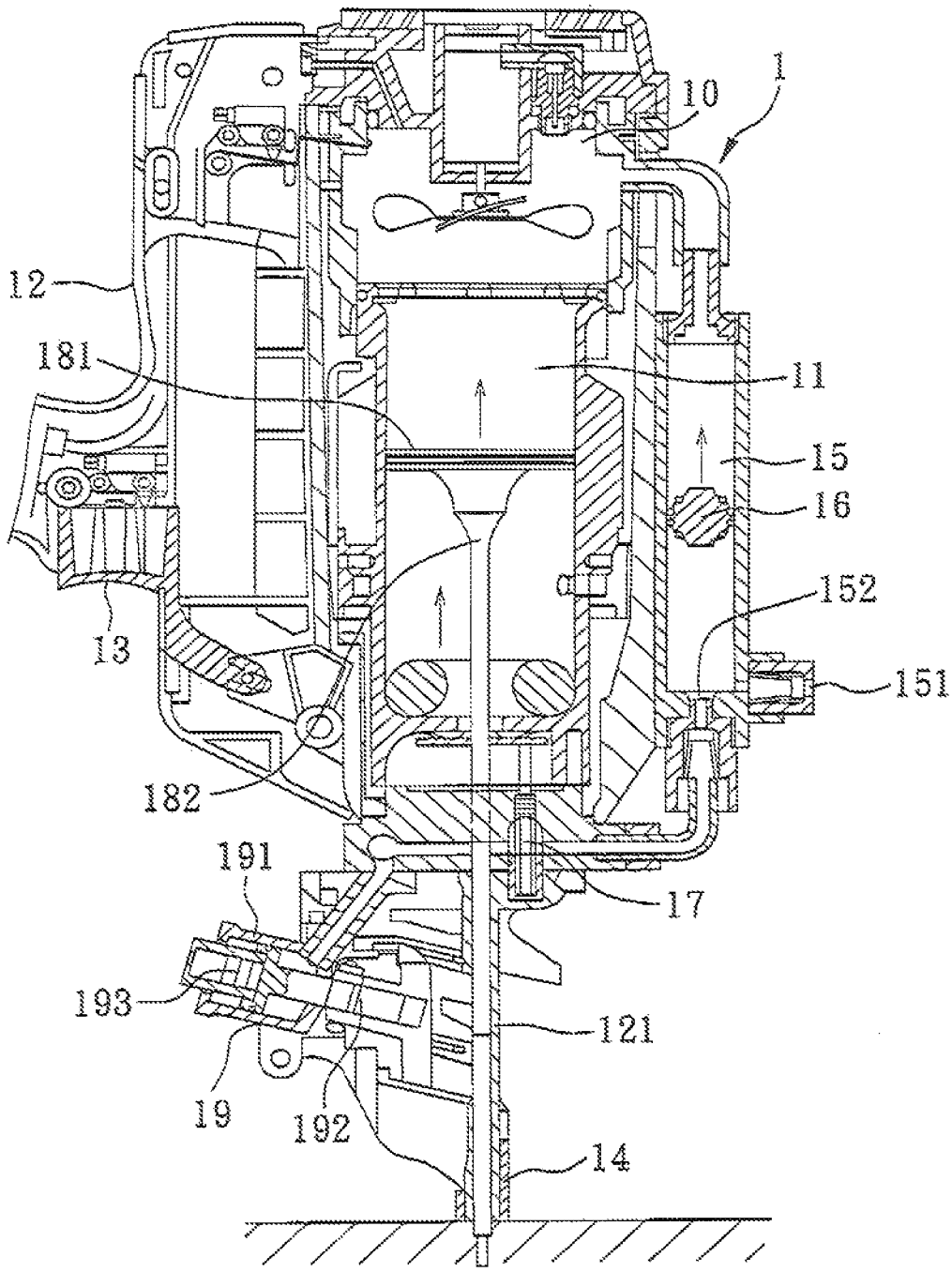
FIG. 2 PRIOR ART
FIG. 2 is a sectional view of the conventional fastener driving tool, showing a striking piston in a returning state.

Before the present invention is described in greater detail, it should be noted that same reference numerals have been used to denote like elements throughout the specification.

Figure 3:
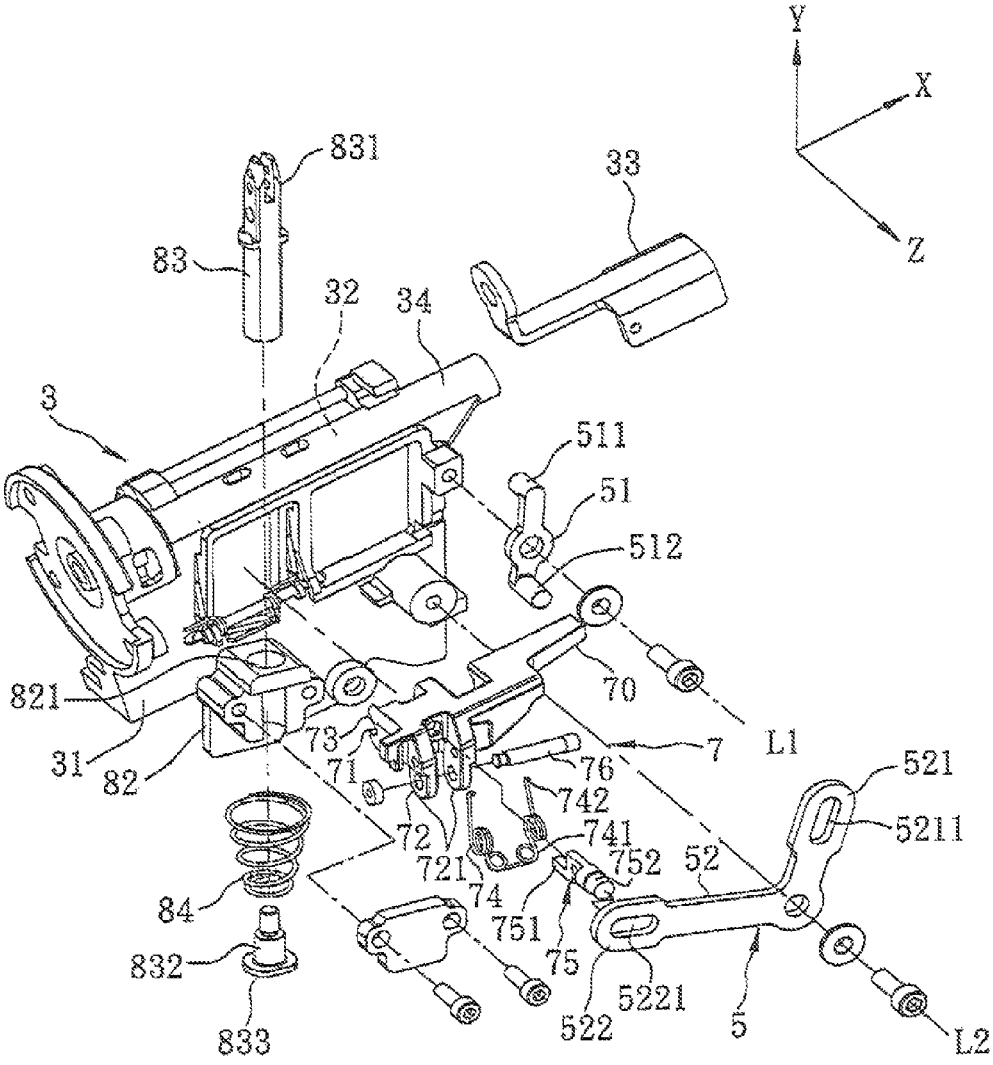
FIG. 3 is an exploded perspective view of the first preferred embodiment of a fastener feeding device according to this invention.
Figure 4:
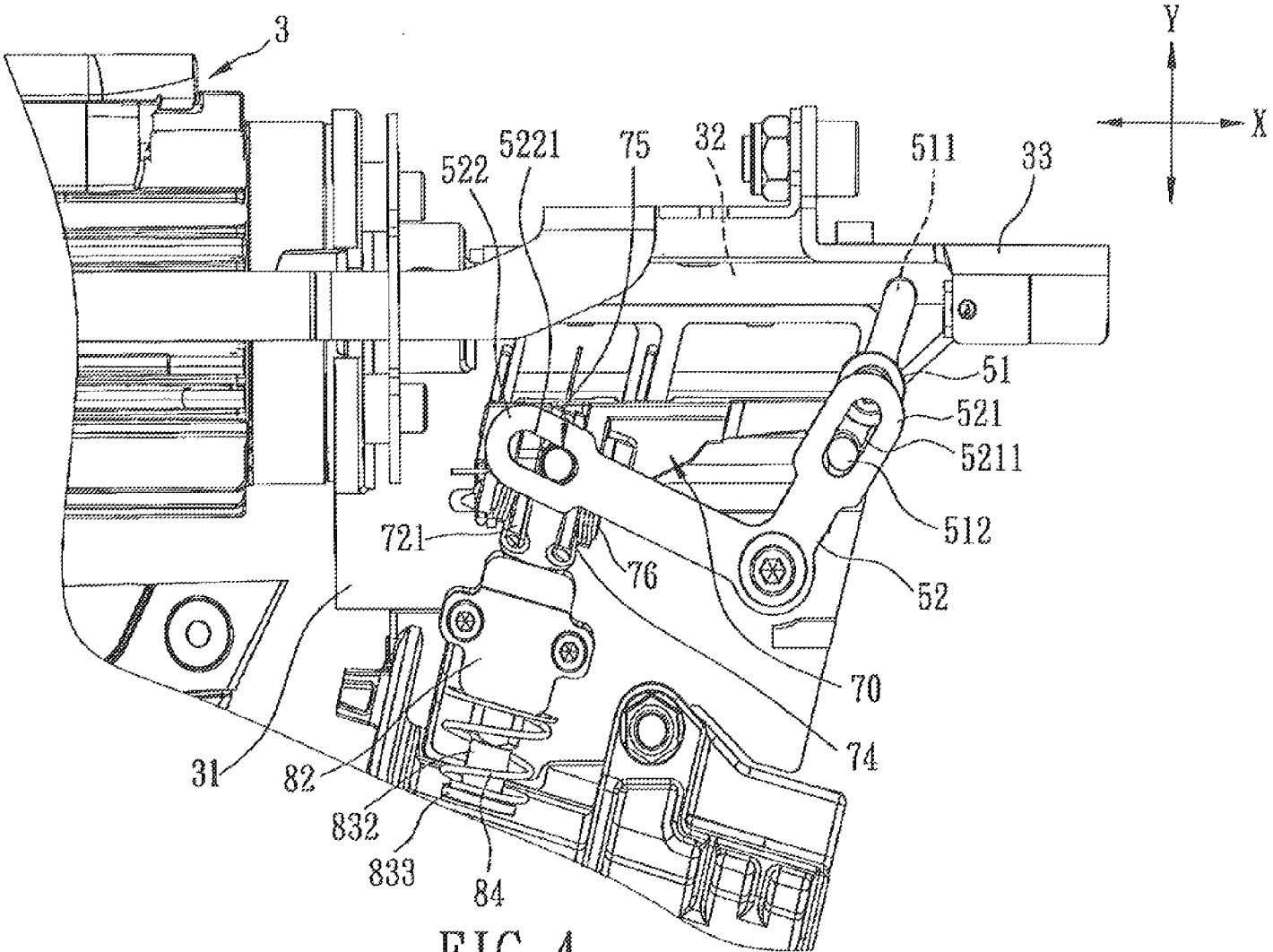
FIG. 4 is a fragmentary side view of the first preferred embodiment.
Figure 5:
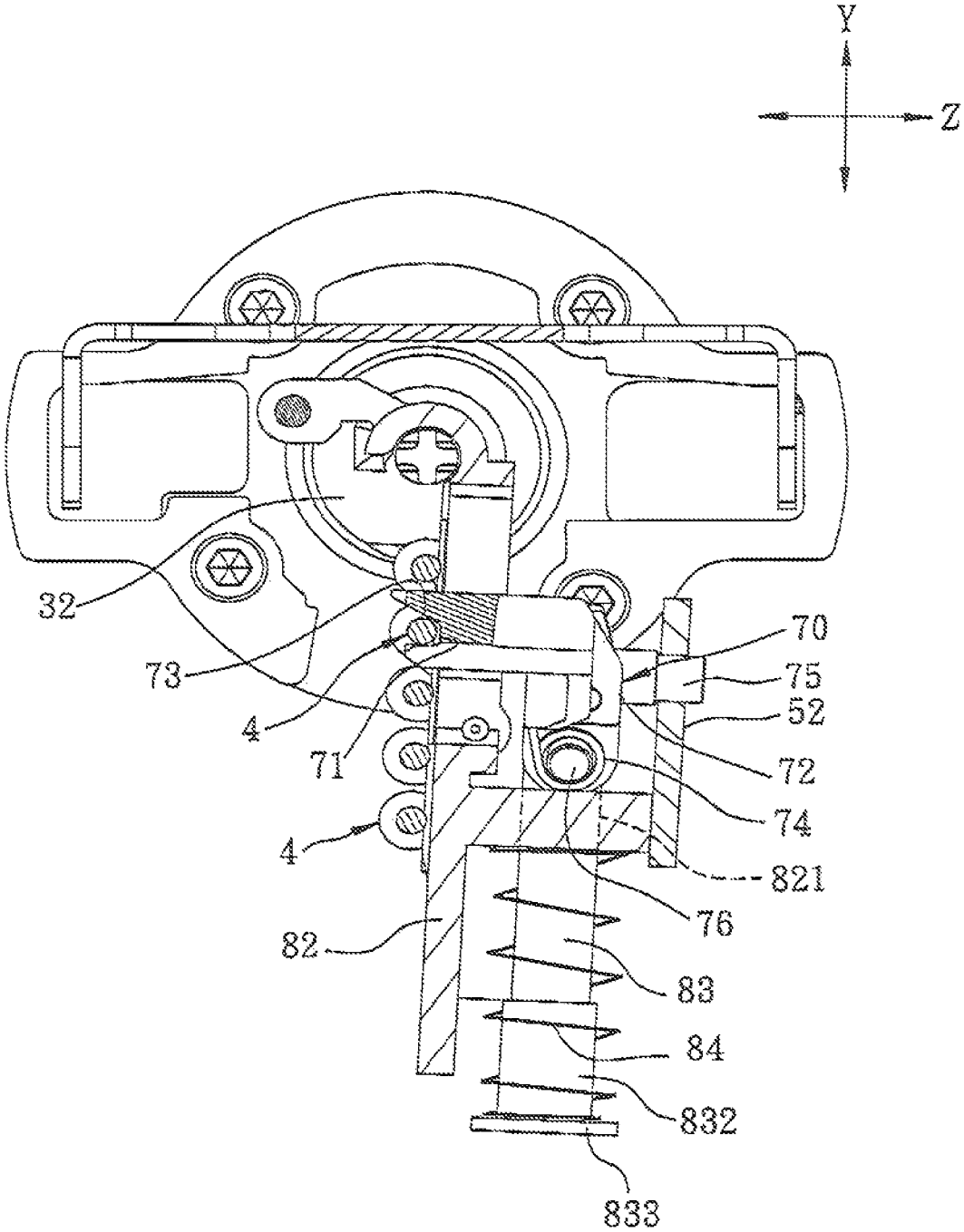
FIG. 5 is a cross-sectional view of the first preferred embodiment, showing a pivotable member in a lower position.

Referring to FIGS. 3 to 5, the first embodiment of a fastener feeding device according to the present invention is adapted to be mounted on a driving tool 3, such as a gas combustion type nailing gun. The driving tool 3 generally has a tool body 31 which defines a striking path 32 extending along a path line in a longitudinal direction X to terminate at a nose part 34, a contact arm 33 movably disposed on the nose part 34 and pressed by a targeted object (not shown) to make a rearward displacement, and a plurality of fasteners 4 disposed in a magazine (not shown) and displaced from one another in a feeding direction (Y) and each extending along a shank axis parallel to the path line.

The fastener feeding device is shown to comprise a mounting seat 82, an uplifting unit 7, a movement guiding member 83, a return biasing member 84, and a force transmitting unit 5.

The mounting seat 82 is adapted to be mounted to the tool body 31 and under the striking path 32. 10. The uplifting unit 7 includes a pushing bracket 70, a torsion spring 74, and a lifting member 75.

The pushing bracket 70 is disposed to be movable relative to the mounting seat 82 in the feeding direction between upper and lower positions. The pushing bracket 70 includes IS a pivotable member 72 and a claw member 71 radially opposite to each other. The pivotable member 72 has two bearing lugs 721 spaced apart from each other in the longitudinal direction (X). A pivot axle 76 extends along a torsion axis that is oriented in the longitudinal direction (X) and is journalled on the bearing lugs 721 such that the pushing bracket 70 is pivotable about the torsion axis. The claw member 71 is configured to holdingly engage a second one of the fasteners 4 during an upward movement of the fasteners 4 from a pre-feed position (see FIG. 5), that corresponds to the lower position of the pushing bracket 70, to a fed position (see FIG. 7), where the shank axis of a leading one of the fasteners 4 is in line with the path line of the striking path 32 when the pushing bracket 70 is displaced to the upper position. The claw member 71 has an actuated surface 73 which faces downwardly and which is inclined in a transverse direction (Z) that is transverse to both the longitudinal direction (X) and the feeding direction (Y).

The torsion spring 74 is coupled with the pushing bracket 70 to exert an angularly biasing force about the torsion axis so as to urge the claw member 71 toward the fasteners 4.

The lifting member 75 is in the form of a bolt, and has a lifting end 751 which is coupled with the pushing bracket 70 to effect the upward movement of the fasteners 4, and an actuated end 752 which is opposite to the lifting end 751 in the transverse direction (Z).

The movement guiding member 83 is disposed to fittingly extend through, and be movable relative to the mounting seat 82 in the feeding direction (Y) through an axial hole 821, and has an upper segment 831 configured to be coupled with one of the pivotable member 72 and the lifting member 75 through the pivot axle 76 so as to ensure an identical route for the upward and downward movements of the pushing bracket 70, and a lower segment 832 which extends away from the mounting seat 82 to terminate at an enlarged end 833. The return biasing member 84 is disposed between the mounting seat 82 and the enlarged end 833 to bias the enlarged end 833 to move away from the mounting seat 82, thereby biasing the pushing bracket 70 toward the lower position.

In this embodiment, the torsion spring 74 is formed with two spring portions surrounding the pivot axle 76, and each of the coil spring portions having two ends 741, 742 which are configured to abuttingly engage with the upper segment 831 of the movement guiding member 83 and the pushing bracket 70, respectively.

The force transmitting unit 5 is disposed to couple the contact arm 33 to the actuated end 752 of the lifting member 75 to actuate the lifting end 751 to effect the upward movement of the fasteners 4 in response to the rearward displacement of the contact arm 33. In this embodiment, the force transmitting unit 5 includes first and second levers 51, 52. The first lever 51 is pivotably mounted on the tool body 31 about a first fulcrum axis (L1) oriented in the transverse direction (Z), and has a first power end 511 disposed to be thrust rearward and angularly about the first fulcrum axis (L1) in response to the rearward displacement of the contact arm 33, and a first weight end 512 disposed opposite to the first power end 511 so as to be moved forward and angularly (see FIG. 6). The second lever 52 is of an L-shape, is pivotably mounted on the tool body 31 about a second fulcrum axis (L2) parallel to the first fulcrum axis (L1), and has a second power end 521 formed with an elongated groove 5211 to be linked with the first weight end 512 so as to be moved downward and angularly about the second fulcrum axis (L2) (see FIG. 6) when the first weight end 512 is moved forward and angularly, and a second weight end 522 formed with an elongated groove 5221 to be linked with the actuated end 752 of the lifting member 75 so as to be moved upward and angularly (see FIG. 6) to thereby lift the actuated end 752 when the second power end 521 is moved downward and angularly. Each of the elongated grooves 5211, 5221 extends toward the second fulcrum axis (L2) such that a corresponding one of the first weight end 512 and the actuated end 752 is slidably engaged in the elongated groove 5211, 5221 to accommodate a radial displacement of a corresponding one of the first weight ends 512 and the actuated end 752.

Figure 6:
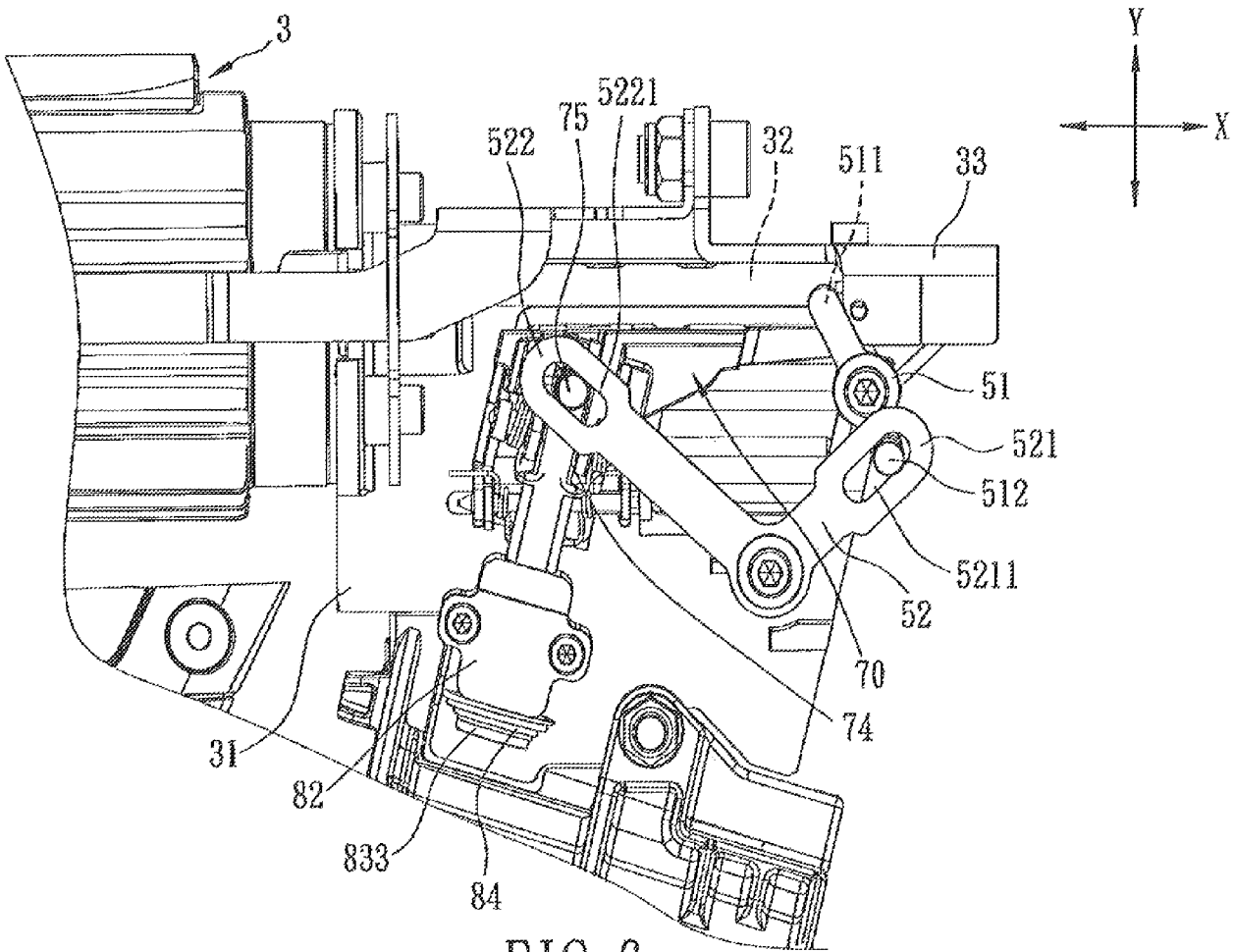
FIG. 6 is a fragmentary side view showing the pivotable member in an upper position.
Figure 7:
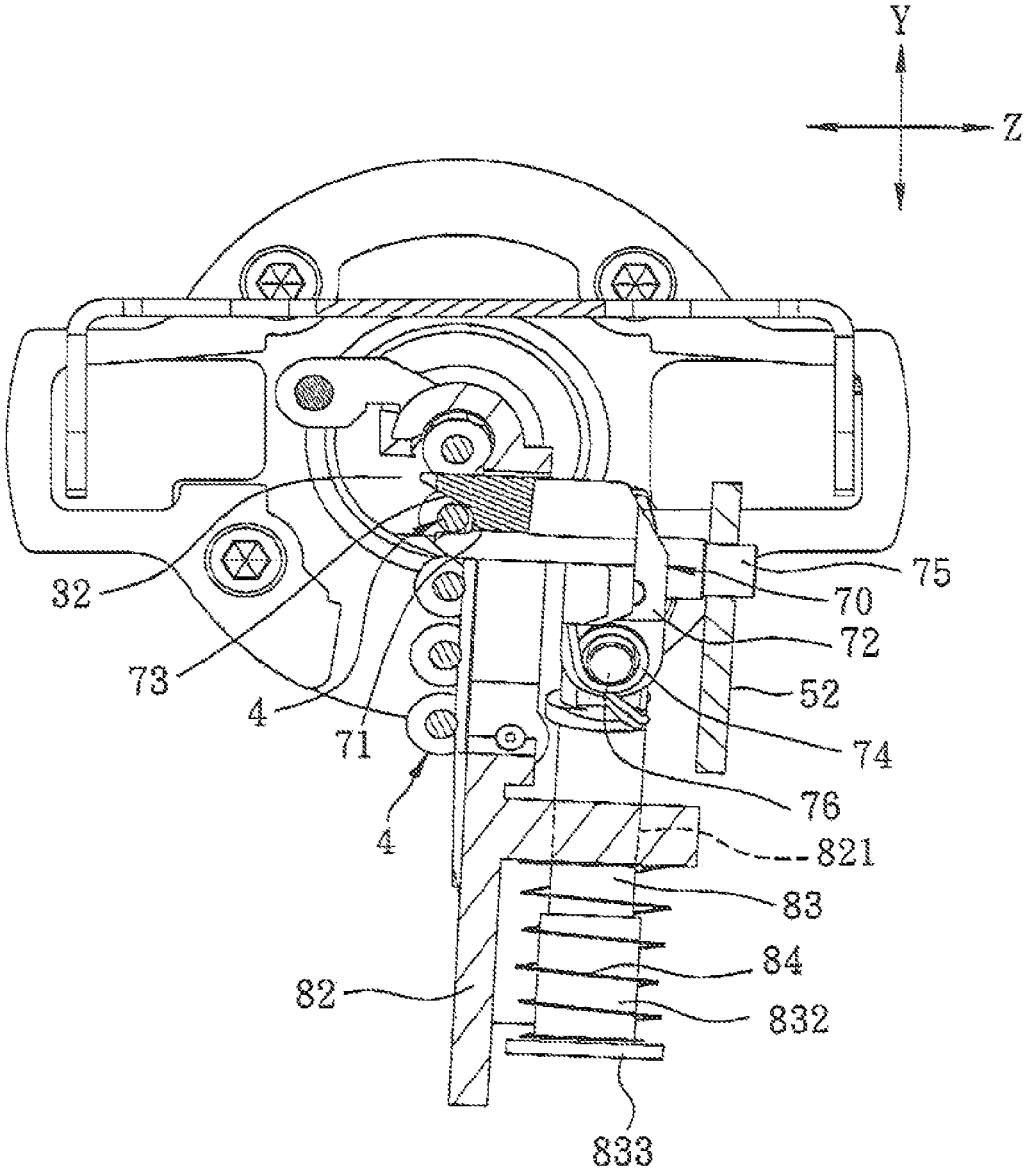
FIG. 7 is a cross-sectional view showing the pivotable member in the upper position.

Referring to FIGS. 3, 6 and 7, when the contact arm 33 is pressed against a targeted object to make the rearward displacement, the first power end 511 of the first lever 51 is thrust rearward and angularly to move the first weight end 512 forward and angularly while the second power end 521 is moved downward and angularly to move the second weight end 522 upward and angularly. Therefore, the pushing bracket 70 is moved by the lifting member 75 to the upper position so as to make the upper movement of the fasteners 4 to the fed position, where the shank axis of the leading fastener 4 is in line with the path line for performing a striking process. At this stage, the pushing bracket 70 is disposed to laterally shield the striking path 32 to prevent possible incident resulting from a skewed impact force exerted on the fed fastener 4 at the fed position.

Figure 8:
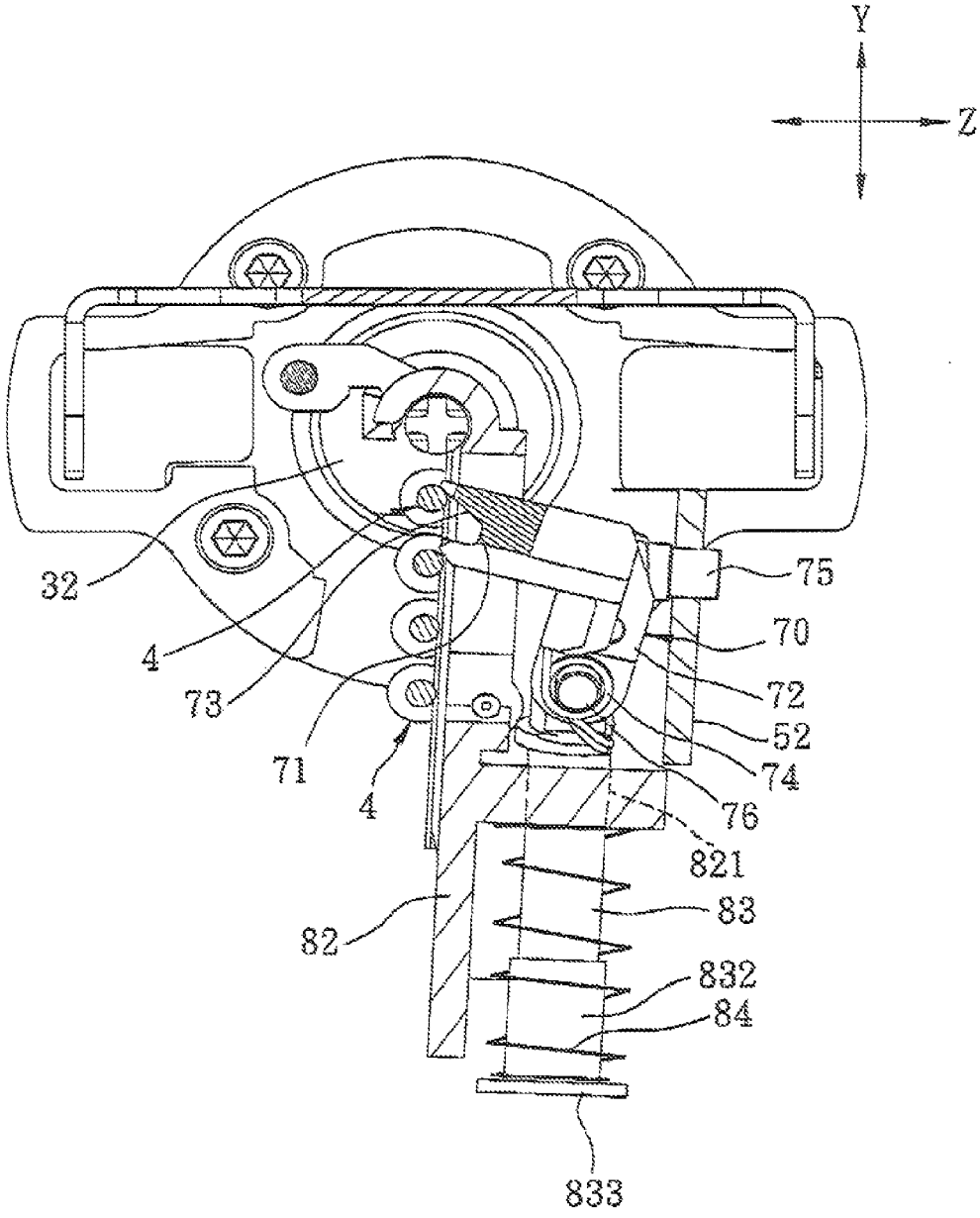
FIG. 8 is a cross-sectional view showing a claw member being dragged downward.

Referring to FIGS. 4, 7 and 8, after the striking process is completed and the contact arm 33 is removed from the targeted object, the movement guiding member 83 is moved downward by the return biasing member 84 to move the pushing bracket 70 back to the lower position (see FIG. 5). During such movement, the actuated surface 73 of the claw member 71 is dragged down and over the second fastener 4 against the angularly biasing force of the torsion spring 74 to engage the third fastener 4 which had taken the place of the second fastener 4 at the pre-feed position once the pivotable member reaches the lower position.

Figure 9:
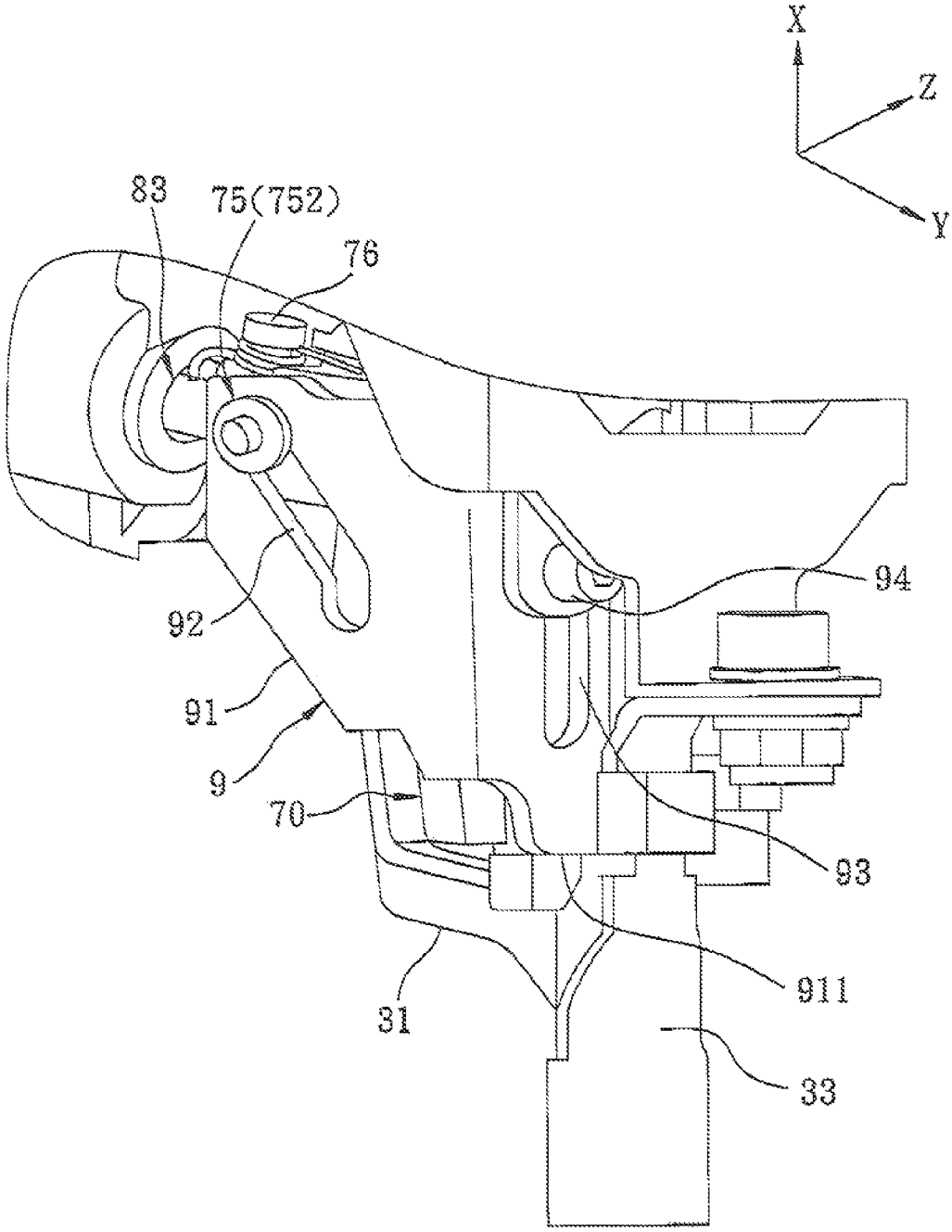
FIG. 9 is a perspective view of the second preferred embodiment of a fastener feeding device according to this invention.
Figure 10:
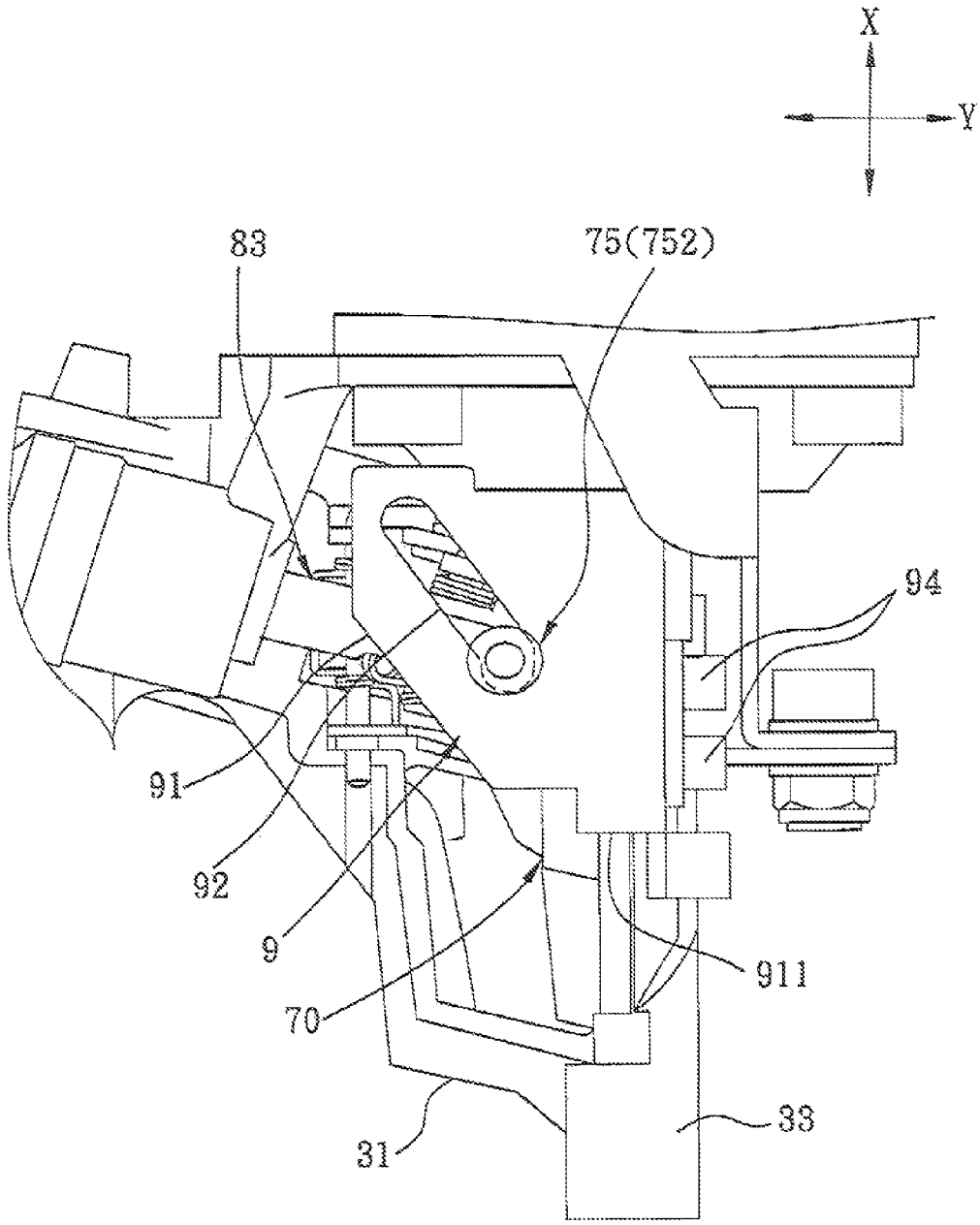
FIG. 10 is a side view of the second preferred embodiment, showing a lifting member in a lifting state.

Referring to FIGS. 9 and 10, the second embodiment of a fastener feeding device according to this invention is similar to the first embodiment in construction except for the force transmitting unit 9. In the second embodiment, the force transmitting unit 9 has an actuating member 91 which is formed with an elongated slot 93 extending in the longitudinal direction (X), and a cam slot 92 engaged with the actuated end 752 of the lifting member 75, and forward and rearward stops 94 which is adapted to be mounted on the tool body 31, which extend through the elongated slot 93, and which are spaced apart from each other in the longitudinal direction (X). When the contact arm 33 is pressed against a targeted object to make the rearward displacement to abut against a front abutment 911 of the actuating member 91, the actuating member 91 is moved in the longitudinal direction (X) while the lifting member 75 is moved along the cam slot 92 to make an upward movement in the feeding direction (Y). Moreover, the forward and rearward stops 94 can limit the longitudinal movement of the actuating member 91.

As illustrated, the fastener feeding device according to this invention is operatively connected to the contact arm 33 to be initiated by the rearward displacement of the contact arm 33 when the driving tool 3 is in the fastener driving operation. That is, no fastener 4 is present in the striking path 32 of the tool body 31 in a non-driving state. Thus, no additional manual operation is required, and safety of the driving tool is ensured. Moreover, since the fastener feeding operation according to this invention is activated by virtue of a rearward displacement of the contact arm 33, rather than a compressed air generated by the action of combustion gas as in the prior art, the problem of accumulation of carbon contents in a conduit can be removed. Besides, the fastener feeding device in accordance with this invention can be adapted for use in any types of fastener driving tools. Furthermore, by the angularly biasing force of the torsion spring 74 which angularly urges the pushing bracket 70 toward the fasteners 4, when the pushing bracket 70 is moved from the upper position to the lower position, the claw member 71 is pivoted about the torsion axis and dragged downward to engage the third fastener 4. Therefore, the return movement of the pushing bracket 70 toward the lower position is smooth without interfering with the fasteners 4.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A fastener feeding device for a driving tool that has a tool body which defines a striking path extending along a path line in a longitudinal direction to terminate at a nose part, a contact arm movably disposed on the nose part and pressed by a targeted object to make a rearward displacement, a plurality of fasteners displaced from one another in a feeding direction and each extending along a shank axis parallel to the path line, said fastener feeding device comprising:

a mounting seat adapted to be mounted to the tool body and under the striking path;

an uplifting unit including a pivotable member which is configured to be pivotable about a torsion axis that is oriented in the longitudinal direction, and which is disposed to be movable relative to said mounting seat in the feeding direction between upper and lower positions, a torsion spring disposed to couple with said pivotable member to exert an angularly biasing force about the torsion axis, a claw member which is radially opposite to said pivotable member, which is urged by the angularly biasing force, and which is configured to holdingly engage the second one of the fasteners during an upward movement of the fasteners from a pre-feed position that corresponds to the lower position to a fed position, where the shank axis of a leading one of the fasteners is in line with the path line, when said pivotable member is displaced to the upper position, said claw member being further configured such that, as a result of a downward movement of said pivotable member from the upper position to the lower position, said claw member is dragged downward against the angularly biasing force to engage the third one of the fasteners which had taken the place of the second fastener at the pre-feed position, and a lifting member having a lifting end which is disposed to couple said claw member to effect the upward movement of the fasteners, and an actuated end which is opposite to said lifting end in a direction transverse to both the longitudinal direction and the feeding direction;

a force transmitting unit configured to couple the contact arm to said actuated end to actuate said lifting end to effect the upward movement of the fasteners in response to the rearward displacement of the contact arm; and a return biasing member disposed to bias said pivotable member toward the lower position.

2. The fastener feeding device according to claim 1, wherein said claw member has an actuated surface which faces downwardly and which is inclined in the transverse direction such that, when said pivotable member is moved toward the lower position, said actuated surface is dragged down and over the second one of the fasteners so as to engage the third one of the fasteners once said pivotable member reaches the lower position.

3. The fastener feeding device according to claim 1, further comprising a movement guiding member which is disposed to fittingly extend through, and be movable relative to said mounting seat in the feeding direction, and which has an upper segment configured to couple with one of said pivotable member and said lifting member so as to ensure an identical route for the upward and downward movements of said pivotable member, and a lower segment which extends away from said mounting seat to terminate at an enlarged end.

4. The fastener feeding device according to claim 3, wherein said return biasing member is disposed between said mounting seat and said enlarged end to bias said enlarged end to move away from said mounting seat, thereby biasing said pivotable member toward the lower position.

5. The fastener feeding device according to claim 1, wherein said pivotable member includes two bearing lugs which are spaced apart from each other in the longitudinal direction, said fastener feeding device further comprising a pivot axle which extends along the torsion axis and which is journalled on said bearing lugs.

6. The fastener feeding device according to claim 5, wherein said torsion spring includes two coil spring portions surrounding said pivot axle, and each having two ends which are configured to abuttingly engage with said upper segment and said uplifting unit, respectively.

7. The fastener feeding device according to claim 1, wherein said force transmitting unit includes a first lever which is pivotably mounted on the tool body about a first fulcrum axis oriented in the transverse direction, and which has a first power end that is disposed to be thrust rearward and angularly about the first fulcrum axis in response to the rearward displacement of the contact arm, and a first weight end disposed opposite to said first power end so as to be moved forward and angularly, and a second lever which is pivotably mounted on the tool body about a second fulcrum axis parallel to the first fulcrum axis and which has a second power end that is linked with said first weight end so as to be moved downward and angularly about the second fulcrum axis when said first weight end is moved forward and angularly, and a second weight end that is linked with said actuated end of said lifting member, and that is moved upward and angularly to thereby lift said actuated end when said second power end is moved downward and angularly.

8. The fastener feeding device according to claim 7, wherein each of said second power and weight ends has an elongated groove which extends toward the second fulcrum axis such that a corresponding one of said first weight end and said actuated end is slidably engaged in said elongated groove to accommodate radial displacement of a corresponding one of said first weight end and said actuated end.

9. The fastener feeding device according to claim 1, wherein said force transmitting unit has an actuating member which is disposed to be movable in the longitudinal direction with the rearward displacement of the contact arm, and which is formed with a cam slot that is engaged with said actuated end of said lifting member, and that is configured to move said lifting member in the feeding direction when said actuating member is moved with the rearward displacement of the contact arm.

10. The fastener feeding device according to claim 9, wherein said force transmitting unit further has forward and rearward stops adapted to be mounted on the tool body and disposed to limit the longitudinal movement of said actuating member.

* * * * *